United States Patent [19]

Rodgers et al.

[11] 4,291,849

[45] Sep. 29, 1981

[54] REACTION-JET TORQUER

[75] Inventors: Aubrey Rodgers, Huntsville; Escar L. Bailey, Athens, both of Ala.

[73] Assignee: The United States of America as represented by the Secretary of the Army, Washington, D.C.

[21] Appl. No.: 35,955

[22] Filed: May 4, 1979

[51] Int. Cl.[3] ..... F41G 7/20

[52] U.S. Cl. ..... 244/3.22; 244/3.1; 244/3.16; 74/5.43

[58] Field of Search ..... 244/3.1, 3.15, 3.16, 244/3.22; 74/5.43

[56] References Cited

U.S. PATENT DOCUMENTS 3,813,067 5/1974 Mork ..... 244/3.22
3,891,166 6/1975 May ..... 244/3.22
4,006,356 2/1977 Johnson et al. ..... 244/3.16
4,087,061 5/1978 Burt ..... 244/3.16
4,131,254 12/1978 Underwood ..... 244/3.16

*Primary Examiner*—Harold J. Tudor
*Attorney, Agent, or Firm*—Nathan Edelberg; Robert P. Gibson; Harold W. Hilton

[57] ABSTRACT

A reaction-jet torquer system carried in a projectile to aim the projectile to a target. The torquer system uses the thrust of sonic nozzles to control a gyro rotor inertial frame of reference. The reaction force applied to the gimbal gives the rotor the capability of tracking the target. A sensor carried by the gyro provides logic which identifies and activates the appropriate nozzle or nozzles of the system to generate the required gimbal force.

2 Claims, 5 Drawing Figures

REACTION-JET TORQUER

DEDICATORY CLAUSE

The invention described herein may be manufactured, used, and licensed by or for the Government for governmental purposes without the payment to us of any royalties thereon.

BACKGROUND OF THE INVENTION

Previous known torquing mechanisms use concepts such as gimbal motor drive, push-rods, and magnetics. The present apparatus differs from such known torquing mechanisms in that it uses the gas momentum principle to control the gyro rotor inertial frame of reference. The reaction-jet torquer of the present invention can be used for any type of wide angle two degree-of-freedom gimbal system and is particularly adapted to the system required to survive and operate in a high acceleration environment of the type described in patent application Ser. No. 41 filed Jan. 2, 1979, entitled "High-G Gimbal Platform" by Aubrey Rodgers.

SUMMARY OF THE INVENTION

The reaction-jet torquer system includes a gyro having a rotor therein and having a stored gas energy bottle in the inner gimbal. Four solenoid valves are secured to the inner gimbal 90° apart in communication with the gas bottle. Four sonic nozzles are in the periphery of the inner gimbal in communication with the gas bottle through the solenoid valves. The nozzles exhaust to the atmosphere. A sensor sensitive to incoming illuminated or radiated target signals electrically activates the appropriate solenoid valve to direct a jet stream through the appropriate nozzle to generate the required gimbal force to process the gyro rotor.

DESCRIPTION OF THE PREFERRED EMBODIMENT

Figure 1:
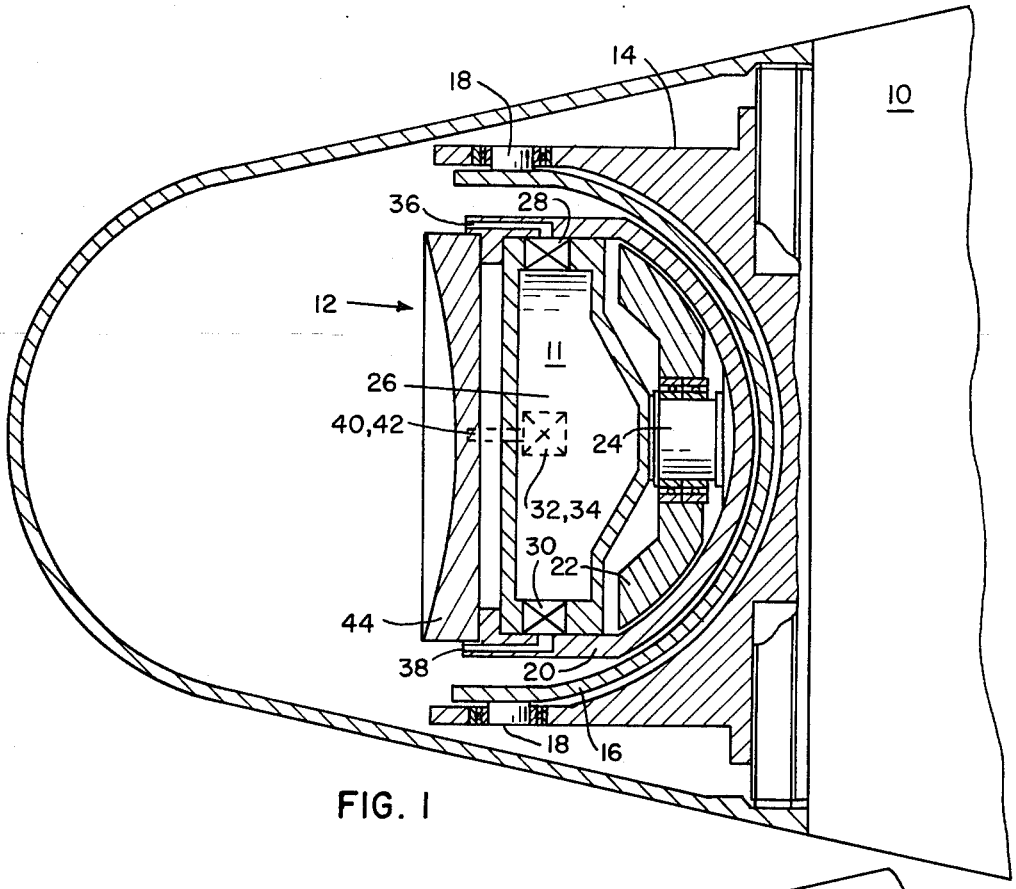
FIG. 1 is an elevational sectional view of the torquer assembly of the present invention.

As seen in FIG. 1, a missile 10 is provided with a gyro assembly 12 including a frame 14 secured to the missile and an outer gimbal 16 secured to the frame by a pair of shafts 18. An inner gimbal 20 is secured in concentric relation with outer gimbal 16 by a pair of shafts (not shown) each displaced 90° from shafts 18. A rotor 22 is secured to inner gimbal 20 by a shaft 24.

A torquer assembly 11 includes a gas energy bottle 26 secured inside inner gimbal 20 for enclosing a source of pressurized gas, four electrically activated minature solenoid valves, 28, 30, 32, and 34 secured to the inner gimbal 90° apart, and four sonic nozzles 36, 38, 40, 42 secured to the inner gimbal 90° apart and respectively connected to solenoid valves 28, 30, 32, and 34. A sensor 44 is secured to inner gimbal 20.

Figure 4:
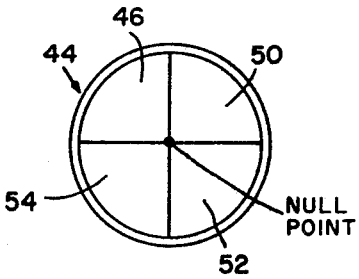
FIG. 4 is an elevational end view of the sensor for activating the reaction-jet torquer.
Figure 5:
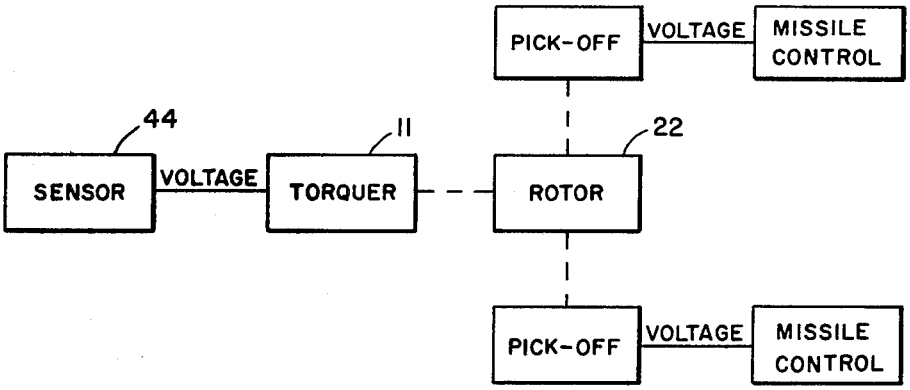
FIG. 5 is a diagrammatic view of the control system for the missile.

Sensor 44 may be any of many types of sensors available, it only being necessary that the sensor is sensitive to incoming illuminated or radiated target signals. The sensor illustrated in FIG. 4 includes four quadrants 46, 50, 52, and 54, each electrically connected to a respective solenoid valve. Pick-offs (FIG. 5) are attached to the frame of the gyro assembly to provide signals for activation of missile control surfaces responsive to gimbal displacement, as is well known in the art.

Figure 2:
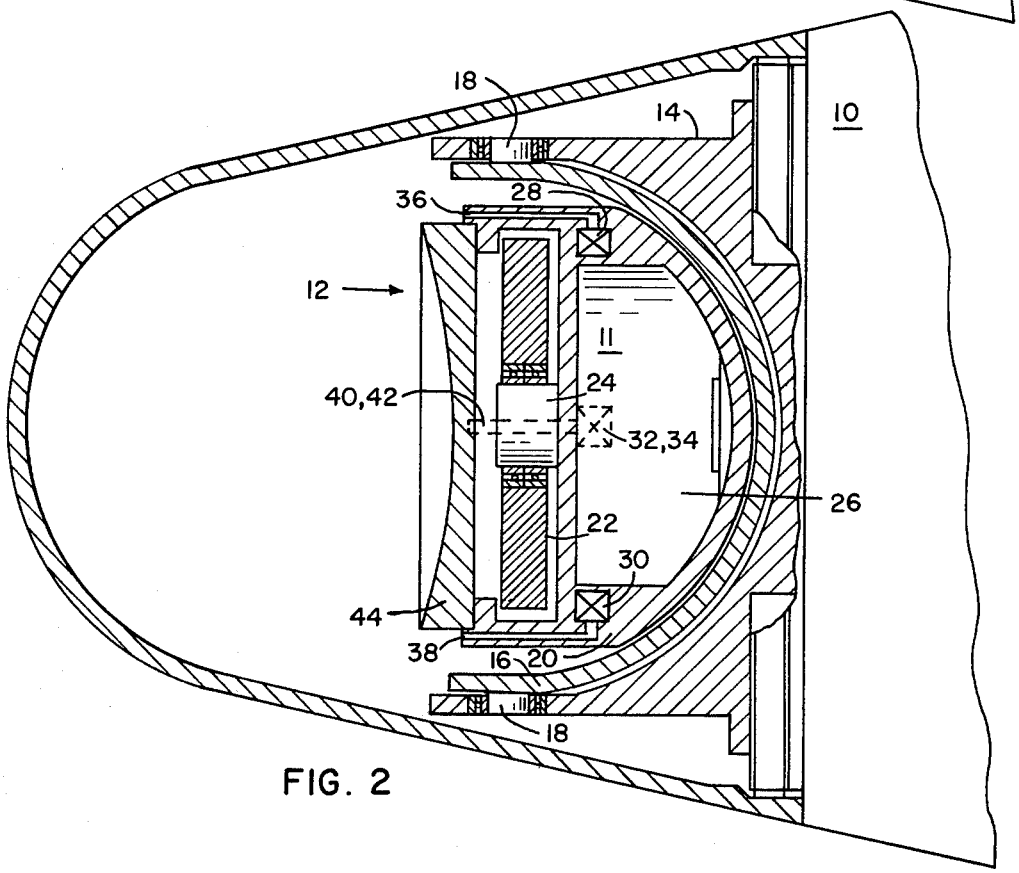
FIG. 2 is an elevational sectional view of another embodiment of the torquer assembly.

In the embodiment shown in FIG. 2, wherein like reference numerals refer to like parts, rotor 22 is mounted in inner gimbal 20 forwardly of gas bottle 26 and solenoid valves 28, 30, 32 and 34 are mounted to the gimbal between nozzles 36, 38, 40 and 42 and the gas bottle. Sensor 44 is mounted to the inner gimbal. Operation of this embodiment is identical to that discussed in the embodiment shown in FIG. 1.

Figure 3:
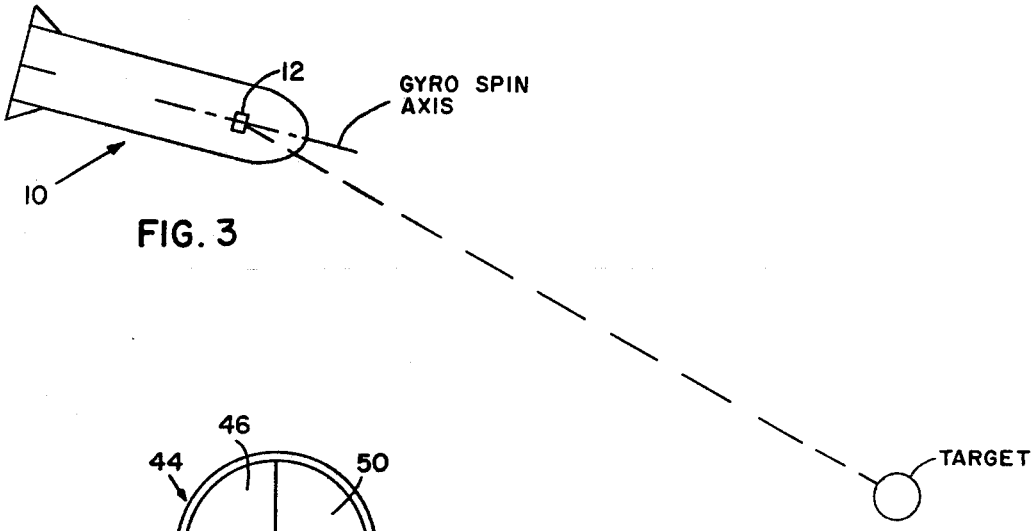
FIG. 3 is a diagrammatic view of a missile utilizing the torquer assembly of the present invention.

In operation, as a missile is in flight to a target (FIG. 3), sensor 44 receives an illuminated or radiated signal from a target, if the missile is on target the signal will be received at its null point. If the missile is not on target, the signal will be in one of the quadrants. Since each quadrant is connected to a respective solenoid valve, the valve which is connected to the energized quadrant will be activated to expel gases therethrough. Momentum will torque the rotor to line of sight with the target and the gyro pickoffs will cause the missile control surfaces to align the missile with the line of sight thus placing the point of illumination on the sensor at the null position.

We claim:

1. In a missile disposed for flight to a target, apparatus for controlling flight of said missile to said target comprising:

a. a gyro assembly including a frame secured to said missile, an outer gimbal secured to said frame, an inner gimbal secured to said outer gimbal, and, a rotor mounted in said inner gimbal;

b. reaction-jet torquer means carried in said inner gimbal for torquing said rotor to line of sight with said target, said reaction jet torquer means including a source of pressurized gas carried in said inner gimbal, four sonic nozzles spaced about said inner gimbal 90° apart, four miniature electrically actuated solenoid valves disposed about said inner gimbal 90° apart, each said valve disposed in communication with said source of gas and one of said nozzles;

c. a sensor carried by said inner gimbal for receiving signals from said target and for transmitting signals for activation of said reaction-jet torquer means, and;

d. control means for guiding said missile to the target response to torquing of said rotor.

2. Apparatus as in claim 1 wherein said sensor is divided into quadrants, each said quadrant being electrically connected to a respective said solenoid valve for selective activation thereof.

* * * * *